United States Patent [19]

Maerfeld

[11] 4,314,098

[45] Feb. 2, 1982

[54] REVERSIBLE ELECTROACOUSTIC TRANSDUCER DEVICE HAVING A CONSTANT DIRECTIVITY CHARACTERISTIC OVER A WIDE FREQUENCY BAND

[75] Inventor: Charles Maerfeld, Paris, France

[73] Assignee: Thomson-CSF, Paris, France

[21] Appl. No.: 90,671

[22] Filed: Nov. 2, 1979

Related U.S. Application Data

[63] Continuation of Ser. No. 913,347, Jun. 7, 1978, abandoned.

[30] Foreign Application Priority Data

Jun. 10, 1977 [FR] France ..... 77 17861

[51] Int. Cl.[3] ..... H04R 1/20

[52] U.S. Cl. ..... 179/1 MF; 179/1 DM; 181/175; 367/151

[58] Field of Search ..... 367/151, 162; 310/335; 181/150, 154, 155, 175, 176, 177, 192, 195; 179/1 MF, 1 DM, 121 D

[56] References Cited

U.S. PATENT DOCUMENTS 2,544,536 3/1951 Kettler ..... 179/1 MF 2,922,140 1/1960 Levine et al. ..... 310/335

3,243,768 3/1966 Roshon, Jr. et al. ..... 310/335

3,302,163 1/1967 Andrews ..... 340/8 FT 3,502,811 3/1970 Schroeder et al. ..... 179/1 DM

FOREIGN PATENT DOCUMENTS 1052541 1/1954 France ..... 179/1 MF

OTHER PUBLICATIONS

Journal of the Acoustical Society of America, vol. 40, No. 6, 1966, pp. 1556–1557, Letters to the Editor, Unique Directional Reflectors for Omnidirectional Underwater Acoustic Transducers, A. A. Crews et al.

Audio Engineering, Mar. 1950, pp. 16–17, A Symmetrical Corner Speaker, Gilson et al.

*Primary Examiner*—George G. Stellar

*Attorney, Agent, or Firm*—Oblon, Fisher, Spivak, McClelland & Maier

[57] ABSTRACT

A device capable of operating over a wide frequency band with a constant angular width of the radiation lobe of elastic waves. It comprises in combination at least one omnidirectional reversible electroacoustic transducer and an assembly of reflecting surfaces of zero acoustic impedance which define a space inside which said transducer is arranged.

12 Claims, 8 Drawing Figures

REVERSIBLE ELECTROACOUSTIC TRANSDUCER DEVICE HAVING A CONSTANT DIRECTIVITY CHARACTERISTIC OVER A WIDE FREQUENCY BAND

This is a continuation of application Ser. No. 913,347, filed June 7, 1978 now abandoned.

BACKGROUND OF THE INVENTION

This invention relates to a device used in submarine acoustics as a projector for emitting and as a hydrophone for receiving elastic waves. More particularly, the invention relates to a reversible electroacoustic transducer device having a constant directivity characteristic over a wide band of frequencies.

It is appropriate at this juncture to recall that the directivity of a transducer is the ability which this transducer has to distribute in a certain manner in space the energy which it exchanges with the propagation medium.

Problems are involved in the effective operation of surveillance listening systems having a wide band of signals propagated in water over the entire horizon. It can easily be shown that, in systems of this type, the signal-to-noise ratio is improved when the space to be monitored is divided into sectors each covered by an electroacoustic assembly having a directive emission characteristic.

However, the directivity obtained by conventional means is a function of frequency and has to be defined for a mean frequency in the service frequency band with the following disadvantages:

- at low frequencies, the sectors thus defined overlap too far because the directional patterns are widened, whereas by contrast,
- at higher frequencies, these sectors no longer overlap because the directional patterns are narrower.

As a result, the useful frequency band of these systems is seriously limited.

Accordingly, there is a need to design electroacoustic assemblies of which the directivity characteristics remain as constant as possible with the frequency situated within the service frequency band.

The invention relates primarily to the production of devices having omnidirectional radiation patterns intended for use in amplitude goniometry systems in submarine acoustics.

However, the devices according to the invention may be used in every case where a given directivity characteristic has to be obtained and maintained over a wide frequency band both in passive reception and in active emission and detection. One example of this latter activity is the wide-band emission intended to obtain information on the frequency response of a submerged object.

Hereinafter a radiating device based on a reversible electroacoustic transducer will be referred to as an "acoustic antenna" or "antenna", both terms which are commonly used by submarine acoustic engineers.

An acoustic antenna may be formed by a vibrating surface of predetermined shape and size, for example a circular piston, or by a network of identical vibrators of which the size is small by comparison with the wavelength and which therefore has an omnidirectional radiation characteristic. In these two cases, the directivity function, which is the variation in sensitivity in dependence upon the direction of the incident wave, depends upon the frequency-size product of the vibrator or network. For the majority of so-called "broadside array" antennae, the angular width $2\alpha$ of the principal lobe with an attenuation of $-3$ dB (whence the term $2\alpha_3$) is approximately inversely proportional to that product. Thus, for an antenna having given dimensions in a frequency band of one octave, the width $2\alpha_3$ decreases by half between the lowest frequency and the highest frequency.

According to the prior art, therefore, the establishment of a constant directivity characteristic as a function of frequency consists in keeping the effective frequency-size product constant. For example, starting from an antenna formed by a linear network of several equidistant electro-acoustic transducers and providing for a determined directivity at the frequency f, it is possible to obtain a constant directivity characteristic at the frequencies 2f and 4f by dividing the network into three sections and by increasing the number of pick-up transducers to form three similar networks (as diagrammatically illustrated in FIG. 1 for the case where the number of transducers is 4).

Other methods may be used and a description of the principal techniques known to the expert may be found in particular in an Article by J. C. MORRIS and F. HANDS "Constant-beam width arrays for wide frequency bands" published in the Journal ACUSTICA, Vol. II, 1961, pages 341–347. These techniques lead to devices which necessitate the use of filters or delay lines combined with a plurality of pick-ups. In addition, disturbances appear in the service frequency band in the overlapping frequency zones of two adjacent sectors.

The device provided by the invention is an acoustic antenna of simple construction of which the directivity characteristic remains constant over a wide frequency band and which comprises a reduced number of electroacoustic transducers.

SUMMARY OF THE INVENTION

According to one of the features of the invention, a reversible electroacoustic transducer device having a constant directivity characteristic over a wide frequency band capable of exceeding an octave and forming an omnidirectional acoustic antenna functioning with an identical angular width of the beam in the sectors subdividing the horizon, comprising a single omnidirectional electroacoustic transducer combined with an assembly of reflecting surfaces of zero acoustic impedance, said assembly of surfaces delimiting a space in the shape of a dihedron, trihedron, pyramid or cone, and in that the distance from said transducer to said reflecting surfaces are selected to be less than 0.4 times of shortest wave-length of said frequency band.

BRIEF DESCRIPTION OF THE DRAWINGS

Various other features and advantages of the invention will become apparent from the following description given by way of example in conjunction with the accompanying drawings, wherein.

DESCRIPTION OF THE INVENTION

To achieve the object on which the invention is based, flat reflectors or reflectors whose shape comprises linear geometries are used in combination with at least one omnidirectional electroacoustic transducer, the acoustic impedance of these reflectors, defined as the complex ratio of dynamic pressure to speed of vibration, being zero.

As a result, the directivity characteristic of the device obtained is dictated by the geometry of the combination formed irrespective of the frequency over a wide band. This is because the surface of each flat reflector used in the acoustic antenna according to the invention forms a flat discontinuity which separates two media of which one has a zero acoustic impedance. The reflection coefficient of the pressure waves at the surface of this discontinuity is equal to $-1$ so that any incident sound pressure is reflected with a change of phase of $\pi$. Accordingly, the directivity characteristic of a single electroacoustic transducer, assumed to be punctiform, placed at a distance z in front of a zero-impedance reflector, also known as a "soft" reflector, is in fact that of a dipole formed by two transducers separated by a distance of 2z and having respective amplitude of $+1$ and $-1$. Accordingly, it may be said that the virtual transducer is the image of the real transducer through the discontinuity.

The reflecting surface of this discontinuity is the site of the points where the sound pressure is zero and defines directions for which the sensitivity is zero.

Figure 1:
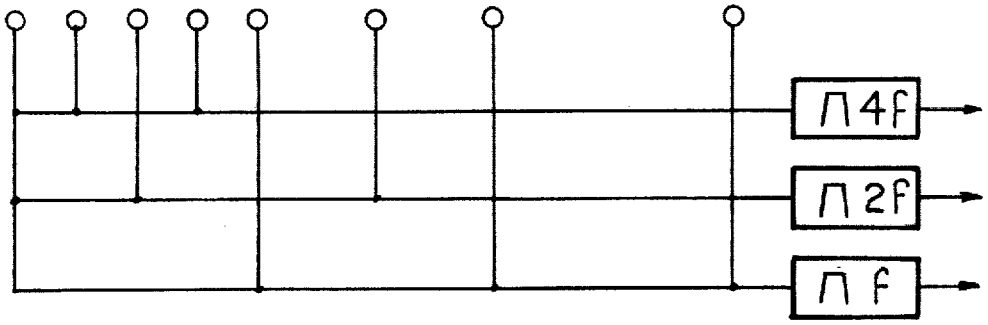
FIG. 1 is a synoptic view of transducers grouped into three similar networks according to the prior art.
Figure 2:
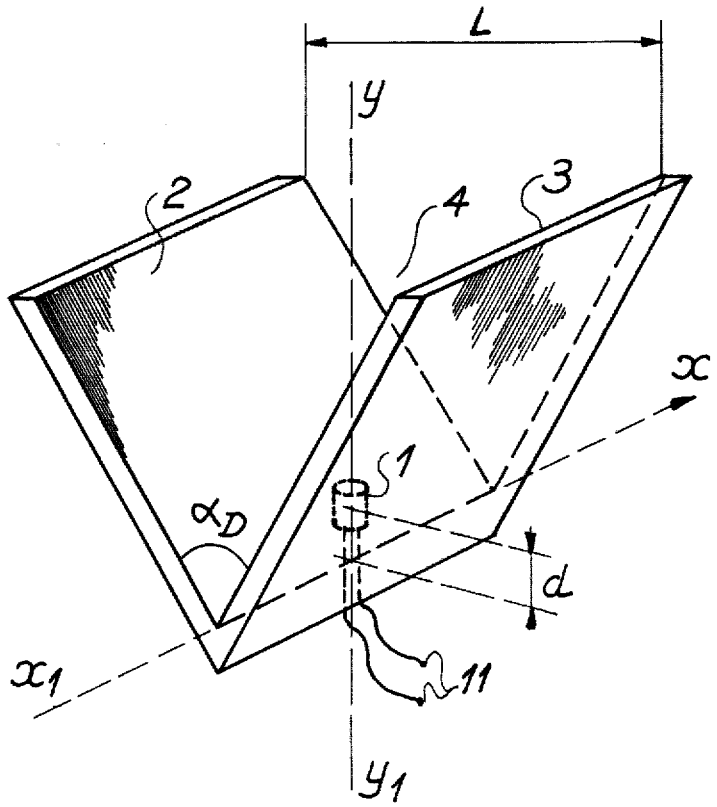
FIG. 2 is a perspective view of a transducer device in the case of a dihedral space according to the invention.

The formation of the acoustic antenna according to the invention consists in combining an assembly of soft reflectors with at least one omnidirectional electroacoustic transducer in accordance with a given geometry. FIG. 2 is a sectional view diagrammatically illustrating the antenna which comprises at least one transducer 1 accommodated inside a space 4 delimited by two "soft" reflectors 2 and 3 forming a dihedron of apex angle $\alpha_D$ along an axis $xx_1$. In the interests of clarity of the drawing, the means used to mount the transducer have not been shown. Since, as has just been mentioned, the equivalent representation of a transducer placed in front of a soft, flat reflector is a dipole $(+1, -1)$ and since, in addition, it can be shown that, for satisfactory operation of the assembly, if the number of dipoles has to be a number n, the angle $\alpha_D$ has to be selected equal to $\pi/n$. In addition, the dihedron has an aperture L which delimits an entry (or exit) pupil. This aperture is selected equal to several times the longest way-length of the frequency band used so that the directivity inherent in this pupil does not contribute towards modifying the directivity characteristic of the antenna at the lowest frequencies of the range.

When the transducer 1 is placed on the bisector $yy_1$ of the apex angle $\alpha_D$ of the dihedron, the amplitude directivity characteristic is:

$$D(\alpha) = \sum_{m=0}^{m=2n-1} (-1)^m e^{i\frac{2\pi d}{\lambda}\cos(\alpha - \frac{m}{n})} \quad (1)$$

In this relation, m is an integer, d is the distance from the transducer to the apex of the dihedron, $\lambda$ is the wave-length of the signal and $\alpha$ is the angle of the radiation taken from the axis $y_1y$. The maximum amplitude is obtained when $\alpha=0$, i.e. in the axis of the dihedron and the width $2\alpha_3$ is equal to $\gamma/2n$, the characteristic of the antenna according to the invention.

The invention will be better understood and its features better defined with the aid of a numerical example described in the following with reference to an embodiment diagrammatically illustrated in FIG. 2.

The two flat reflecting surfaces 2 and 3 of the system of the "soft" reflector type, which are made of a material commonly used in submarine acoustics, such as a closed-cell elastomer foam based on polyvinyl chloride, for example the foam marketed by the Kleber-Colombes company under the trade-name "KLEGECELL 250", form with one another a dihedron of angle $\alpha_D=90°$. The transducer 1 fed at 11 is cylindrical and has a diameter of 1 cm and is situated at a distance d of 1.5 cm from the edge of the dihedron. The width L of the opening is 30 cm.

Figure 3:
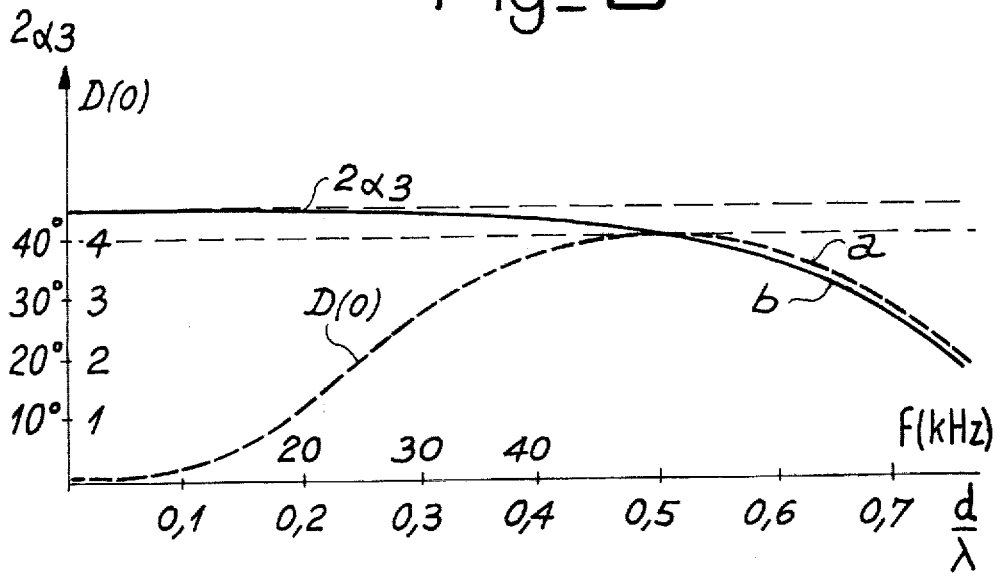
FIG. 3 shows diagrams illustrating in particular the curve of the angular width $2\alpha_3$ of the beam in dependence upon various parameters.

The amplitude of the acoustic wave received or emitted by the described antenna is expressed by the following relation:

$$D(\alpha) = 4\sin\left[\frac{\pi d}{\lambda}(\cos\alpha_3 + \sin\alpha_3)\right] \times \sin\left[\frac{\pi d}{\lambda}(\cos\alpha_3 - \sin\alpha_3)\right]$$

from which it possible to calculate:

the maximum amplitude in the axis D (o)$=4\sin^2(\pi d/\lambda)$ and the width $2\alpha_3$ of the principal lobe at $-3$ dB such that $$\sin\left[\frac{\pi d}{\lambda}(\cos\alpha_3 + \sin\alpha_3)\right] \times \sin\left[\frac{\pi d}{\lambda}(\cos\alpha_3 - \sin\alpha_3)\right] = \frac{\sqrt{2}}{2}\sin^2\frac{\pi d}{\lambda}$$

of which the respective variations are plotted in FIG. 3 at (a) and (b) where the angular width in degrees and/or the amplitude D(o) is recorded on the ordinate and the frequency in kHz and/or the ratio $d/\lambda$ on the abscissa. It can clearly be seen from this Figure that the directivity characteristic obtained is substantially constant over a wide frequency band.

The limitation towards the low frequencies due to the dimensions of the aperture width L of the dihedron will only appear more or less early according to the dimensions given to this width L. In a fixed submarine installation, the dimension L may reach several meters, enabling this limitation to be reduced to approximately 1 kHz. In the described example, corresponding to an antenna on board a submarine vehicle, the dimension L=30 cm enables the service frequency to be reduced to approximately 20 kHz.

The limitation towards high frequencies may be fixed when for example the angular width which corresponds in directivity characteristic $2\alpha_3$ has decreased by 10%. In the described example of embodiment, this means that the frequency corresponding to $d/\lambda=0.4$, i.e. a frequency of 40 kHz, is not exceeded.

There is thus obtained an acoustic antenna of which the directivity characteristic remains constant over a band of one octave.

The power of detection of an antenna such as this may be assessed by calculating the spectral level of the signal $N_S$ which it is able to detect. If $B_E$ is the spectral level of electronic noise at the input of the pre-amplifier of the transducer and if $S_h$ is the sensitivity of the transducer, then $$N_x = B_E - S_h - 20 \log \left( 4 \cdot \sin^2 \frac{\pi d}{\lambda} \right)$$

with scales in decibels.

It is known how to produce transducers of $S_h=-90$ dB with a spectral electronic noise level of $$10^{-8} \text{ volt}/\sqrt{\text{Hz}} .$$

If, in the described embodiment, the low frequency is limited to 20 kHz, i.e. to a frequency corresponding to $d/\lambda=0.2$, the maximum amplitude in the axis $D(o)=4 \sin^2(\pi d/\lambda)$ assumes the value 1.38 as compared with the value obtained at the frequency corresponding to $d/\lambda=0.5$ which is $D(o)=4$, a value which would also be obtained with the gain of a conventional antenna.

Accordingly, $N_S$ −73 dB at the frequency of 20 kHz for the antenna corresponding to the described example.

A compensating filter of the low-pass type is with advantage arranged behind the transducer in order to equalise the level of the signal received in the frequency band used.

Figure 4:
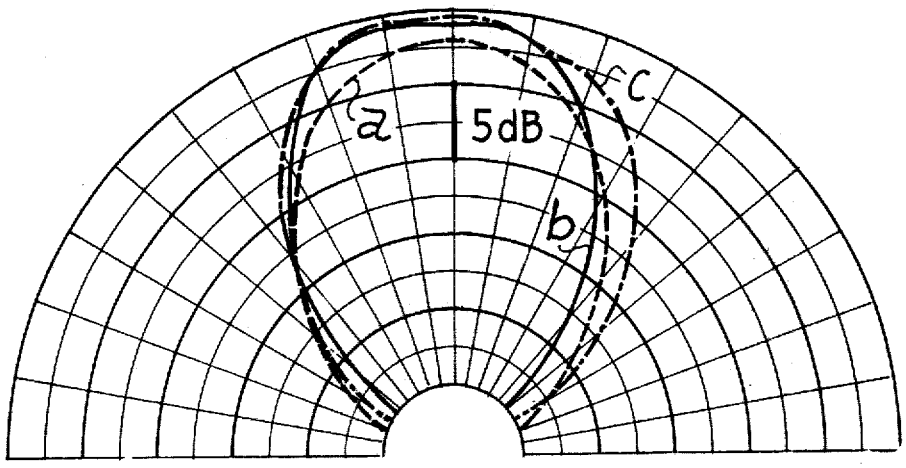
FIG. 4 shows the radiation pattern at 20, 30 and 40 kHz.

FIGS. 4a, 4b and 4c show the radiation patterns obtained at the respective frequencies of 20, 30 and 40 kHz.

Figure 5:
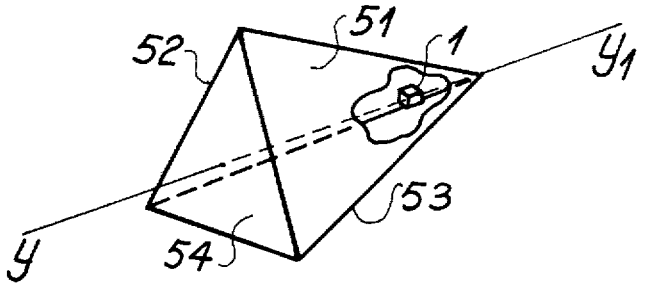
FIG. 5 is a diagrammatic view of the device in the case of a trihedral space containing a transducer according to the invention.

In another embodiment, the acoustic antenna comprises an assembly of 3 or 4 flat "soft" reflectors forming a trihedron or a pyramid. FIG. 5 diagrammatically illustrates one embodiment of the invention formed by three flat reflectors 51, 52 and 53 which delimit a trihedral space 54 and by an electroacoustic transducer 1. The directivity characteristic obtained delimits a space sector which is symmetrical in volume in relation to the height of the trihedron or the pyramid.

In one variant, the transducer is placed inside a "soft" reflecting cone and provides a directivity characteristic similar to that of a group of hydrophones designed in such a way that the sensitivity maximum corresponds to the directivity characteristic of the axis of the group, i.e. in a radiation pattern similar to that produced by a so-called "end-fire array".

Figure 6:
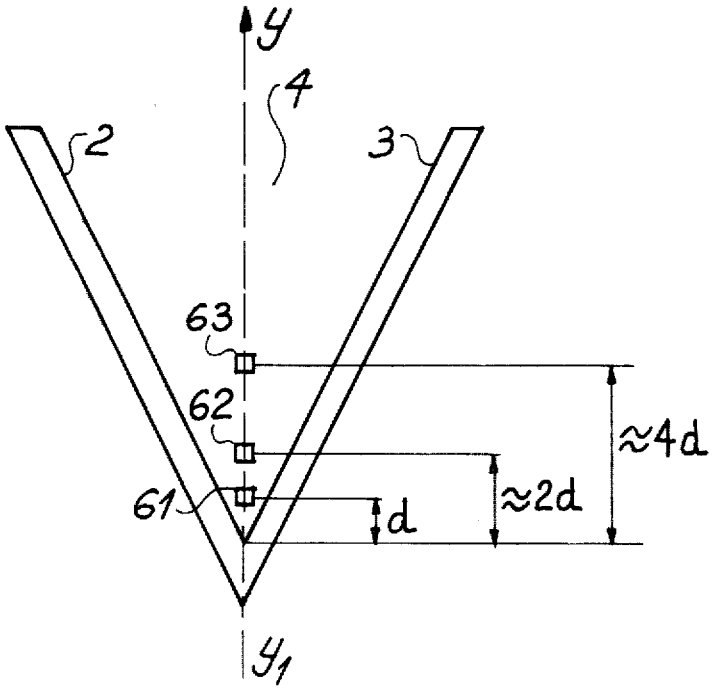
FIG. 6 is a section through a variant of the device illustrated in FIG. 2 in which several transducers are used in accordance with the invention.

In another embodiment, several transducers are with advantage arranged at different distances from the apex of the various possible forms of reflectors so as to cover a wide frequency band comprising several octaves. FIG. 6 is a diagrammatic section through an antenna in which three transducers 61, 62 and 63 are spaced from the summit of the dihedron, formed by the "soft" reflecting surfaces 2 and 3, by values of d, 2d and 4d forming a geometric progression.

The transducers situated nearest the summit are used for the highest frequency bands.

Figure 7:
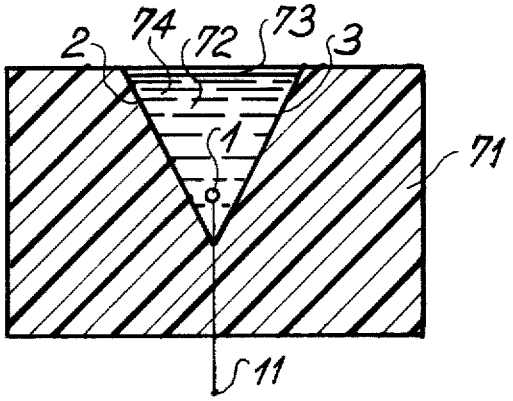
FIG. 7 is a section through another variant in which the space containing the transducer is formed inside a block.

FIG. 7 is a diagrammatic section through an acoustic antenna in the form of a dihedron, trihedron, pyramid or cone formed by a recess 72 of this shape made in a block 71 of "soft" reflecting material, such as the material known as "KLEGECELL" referred to above.

In operation, the recess 72 may communicate directly with the fluid of the surrounding medium. In this case, the corresponding space is filled with this fluid and the transducer 1 has to be protected and supported.

As shown in FIG. 7, the aperture of this recess 72 is closed by a thin foil 73, for example of rubber $\lambda_o C_o$, and the recess is filled with a fluid of the type commonly used in submarine acoustics, such as castor oil or silicone oil, having acoustic properties similar to those of the surrounding fluid.

It is of greater advantage to fill the recess 72 with a viscoelastic material having the acoustic transparency a water, such as the polyurethane described for example in the British Pat. No. 1,337,778, so as to protect and support the transducer(s).

Several acoustic antennae of the type described above may be grouped together to form a network which enables interesting directivity characteristics to be obtained with a reduced number of electroacoustic transducers.

Figure 8:
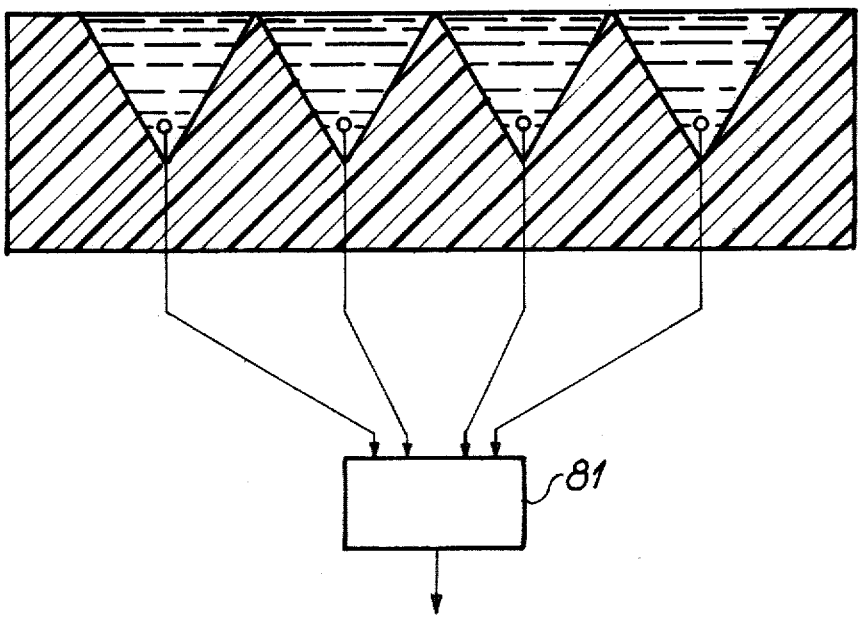
FIG. 8 is another view in section of a group of several devices of the type illustrated in FIG. 7 which are linked to an apparatus for processing the signals.

FIG. 8 is a diagrammatic section through a group of four individual antennae of the type illustrated in FIG. 7. This group of antennae collects in particular the signals received and the outputs of the transducers are connected to a processing circuit 81 so as to obtain the required directivity characteristics. A circuit of this type comprises for example filters and amplifiers with an adder or with a multiplexer enabling the required treatment(s) to be applied to the signals.

On the other hand, the antenna thus obtained enables amplitude goniometry to be effected over a wide frequency band providing the output signals of each individual antenna are separately considered.

What is claimed is:

1. A reversible electroacoustic transducer device having a constant directivity characteristic over a wide frequency band capable of exceeding an octave and forming a directional acoustic antenna in a propagation medium, comprising:

at least one omnidirectional electroacoustic transducer having dimensions less than one-half the wave length of the highest frequency of said wide frequency band in the propagation medium;

linear geometric surface means for reflecting acoustical signals to and from said at least one transducer, comprising plural linear geometric surfaces each having zero acoustic impedance, said surfaces delimiting a geometrically shaped space and including at least two lateral walls defining respective planes which form an apex at the intersection of said planes and an aperture opposite said apex;

said aperture dimensioned at least twice the wavelength of the lowest frequency of said wide frequency band; and said at least one electroacoustic transducer having a center placed in the space delimited by said reflecting surfaces at a distance from said apex less than 0.4 times the wavelength of the highest frequency of said wide frequency band.

2. A device as claimed in claim 1, wherein:

said space is filled with a material having the acoustic transparency of the fluid of the surrounding medium in operation.

3. A device as claimed in claim 1, wherein:

said aperture of said space is closed by an acoustically transparent foil, said space being filled with a fluid having an acoustic impedance similar to that of the fluid of the surrounding medium in operation.

4. A device as claimed in claim 1, wherein:

said transducer means consists of a single omnidirectional electroacoustical transducer.

5. A device as claimed in claim 1, wherein:

said space delimited by said reflecting surface means is a trihedron.

6. A device as claimed in claim 1, wherein:

said space delimited by said reflecting surface means is a pyramid.

7. A device as claimed in claim 1, wherein:

said space delimited by said reflecting surface means is a cone.

8. A device as claimed in claim 1, wherein:

said space delimited by said reflecting surface means is a dihedron.

9. A device as defined in claim 8, wherein:

said reflecting surface means determine a geometric figure having an apex angle equal to $\pi/n$ where n is an integer.

10. A device as claimed in claim 1 including:

a plurality of omnidirectional electroacoustic transducers, and said transducers being placed in said geometrical figure at distances from said apex inversely proportional to said working frequencies.

11. A device as claimed in claim 10, including:

a plurality of compensating low-pass filters, each said low-pass filter being connected to the output of each corresponding omnidirectional transducer.

12. An assembly forming a new detection antenna enabling good directivity characteristics to be obtained with a reduced number of transducers, comprising a plurality of transducers as claimed in claim 10 and circuit means connected to the outputs of said transducers for processing the signals delivered by said transducers.

* * * * *